US011112142B2

(12) United States Patent
Bewley, Jr. et al.

(10) Patent No.: US 11,112,142 B2
(45) Date of Patent: Sep. 7, 2021

(54) COVER ASSEMBLY FOR AN OPENING IN A BULKHEAD OF AN AIR CONDITIONER UNIT

(71) Applicant: Haier US Appliance Solutions, Inc., Wilmington, DE (US)

(72) Inventors: Wilbur Carl Bewley, Jr., Nicholasville, KY (US); Robert William Jewell, Aurora, OH (US); Stephen D. Hatcher, Henryville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 60 days.

(21) Appl. No.: 16/154,863

(22) Filed: Oct. 9, 2018

(65) Prior Publication Data

US 2020/0109875 A1 Apr. 9, 2020

(51) Int. Cl.
*F24F 13/20* (2006.01)
*F24F 1/027* (2019.01)

(52) U.S. Cl.
CPC ..... *F24F 13/20* (2013.01); *F24F 1/027* (2013.01)

(58) Field of Classification Search
CPC ..... F24F 13/224; F24F 13/22; F24F 13/222; F24F 1/031; F24F 2221/20; F24F 1/62; F24F 13/20; F24F 1/027; F24F 1/0314; F24F 13/18; F16J 2015/0868; F16J 55/78
See application file for complete search history.

(56) References Cited

U.S. PATENT DOCUMENTS

| | | | | |
|---|---|---|---|---|
| 3,762,182 | A * | 10/1973 | Loos | F24F 1/027 62/427 |
| 4,385,504 | A | 5/1983 | Perrone et al. | |
| 5,388,425 | A * | 2/1995 | Bolton | F24F 1/027 174/51 |
| 6,061,981 | A * | 5/2000 | Nieves | F24F 13/20 52/202 |
| 6,262,367 | B1 * | 7/2001 | Correa | H01G 2/106 174/535 |
| 7,389,616 | B2 * | 6/2008 | Gilleran | E04F 13/0869 52/219 |
| 2011/0105011 | A1 * | 5/2011 | Dubensky | F24F 13/20 454/195 |
| 2016/0313014 | A1 * | 10/2016 | Phillips | F24F 13/20 |

FOREIGN PATENT DOCUMENTS

| | | | |
|---|---|---|---|
| CN | 2615377 | Y | 5/2004 |
| JP | H01196433 | A | 8/1989 |
| JP | 2002243213 | A | 8/2002 |
| WO | WO2008077206 | A2 | 7/2008 |

* cited by examiner

*Primary Examiner* — Emmanuel E Duke
(74) *Attorney, Agent, or Firm* — Dority & Manning, P.A.

(57) ABSTRACT

An air conditioner unit and cover assembly therefore are provided. In one exemplary aspect, the air conditioner unit includes a bulkhead that defines an indoor portion and an outdoor portion of the unit. A wall of the bulkhead defines an opening that is accessible from the outdoor portion of the unit and is sized to allow various components to be accessed, serviced, and assembled through the opening. The unit includes a removable cover assembly that includes a cover and a gasket. The cover assembly and the wall of the bulkhead include various features for sealing the perimeter of the opening and for guiding one or more wires into the opening.

20 Claims, 12 Drawing Sheets

COVER ASSEMBLY FOR AN OPENING IN A BULKHEAD OF AN AIR CONDITIONER UNIT

FIELD OF THE INVENTION

The present disclosure relates generally to air conditioner units and more particularly to a cover assembly for covering an opening defined by a bulkhead of an air conditioner unit.

BACKGROUND OF THE INVENTION

Air conditioner or conditioning units are conventionally utilized to adjust the temperature indoors, e.g., within structures such as dwellings and office buildings. Some types of air conditioning units are specifically designed to condition air within relatively smaller indoor spaces. For example, such air conditioner units may include packaged terminal units including packaged terminal air conditioner units (PTAC) and packaged terminal heat pumps (PTHP), single package vertical units (SPVU) including single package vertical air conditioners (SPVAC) and single package vertical heat pumps (SPVHP), built ins, and window units. Such units may include both an indoor portion and an outdoor portion separated by a bulkhead and may be installed in windows or positioned within an opening of an exterior wall of a building, for example.

Assembly and servicing of such air conditioner units has presented a number of challenges. For instance, accessing the control board, electrical wires and connectors, and the capacitor within a control box enclosure defined by the bulkhead has proved to be particularly challenging. Conventional units typically include access to the control box enclosure through the indoor or front portion of the unit. Thus, to access the components within the back of the control box enclosure, the cover of the control box and the components at the front of the control box enclosure must be removed or placed aside so that the components at the back of the enclosure may be accessed. Thus, accessing components within the control box enclosure may be inconvenient and difficult. Further, assembling components, particularly the capacitor and other outdoor portion components, into the control box enclosure has also proved to be challenging.

Accordingly, an improved air conditioner unit that addresses one or more of the challenges noted above would be useful.

BRIEF DESCRIPTION OF THE INVENTION

Aspects and advantages of the invention will be set forth in part in the following description, may be obvious from the description, or may be learned through practice of the invention.

In accordance with one embodiment, an air conditioner unit defining a vertical direction is provided. The air conditioner unit has a bulkhead defining an indoor portion and an outdoor portion, the bulkhead having a wall defining an opening and having an indoor surface facing the indoor portion and an outdoor surface facing the outdoor portion. The wall defines a bulkhead bead projecting outward from the outdoor surface and extending at least partially around the opening. The air conditioner unit also has a cover assembly for covering the opening. The cover assembly includes a cover and a gasket disposed between the cover and the outdoor surface of the wall and in sealing engagement with the bulkhead bead, the gasket having a sealing portion defining a gasket bead projecting outward therefrom and extending at least partially around the sealing portion such that the gasket bead is in sealing engagement with the cover.

In accordance with another embodiment, an air conditioner unit defining a vertical direction is provided. The air conditioner unit includes a bulkhead defining an indoor portion and an outdoor portion, the bulkhead having a wall defining an opening and having an indoor surface facing the indoor portion and an outdoor surface facing the outdoor portion, the outdoor surface of the wall defining a bulkhead bead projecting outward therefrom and extending around the opening. The air conditioner unit also includes a cover assembly for covering the opening. The cover assembly also includes a cover and a gasket disposed between the cover and the outdoor surface of the wall, the gasket having a sealing portion defining a gasket bead projecting outward therefrom and extending around the sealing portion, wherein the gasket bead is in sealing engagement with the cover and the bulkhead bead is in sealing engagement with the sealing portion of the gasket, and wherein a ridge of the bulkhead bead and a ridge of the gasket bead are substantially aligned.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures in which.

DETAILED DESCRIPTION OF THE INVENTION

Figure 1:
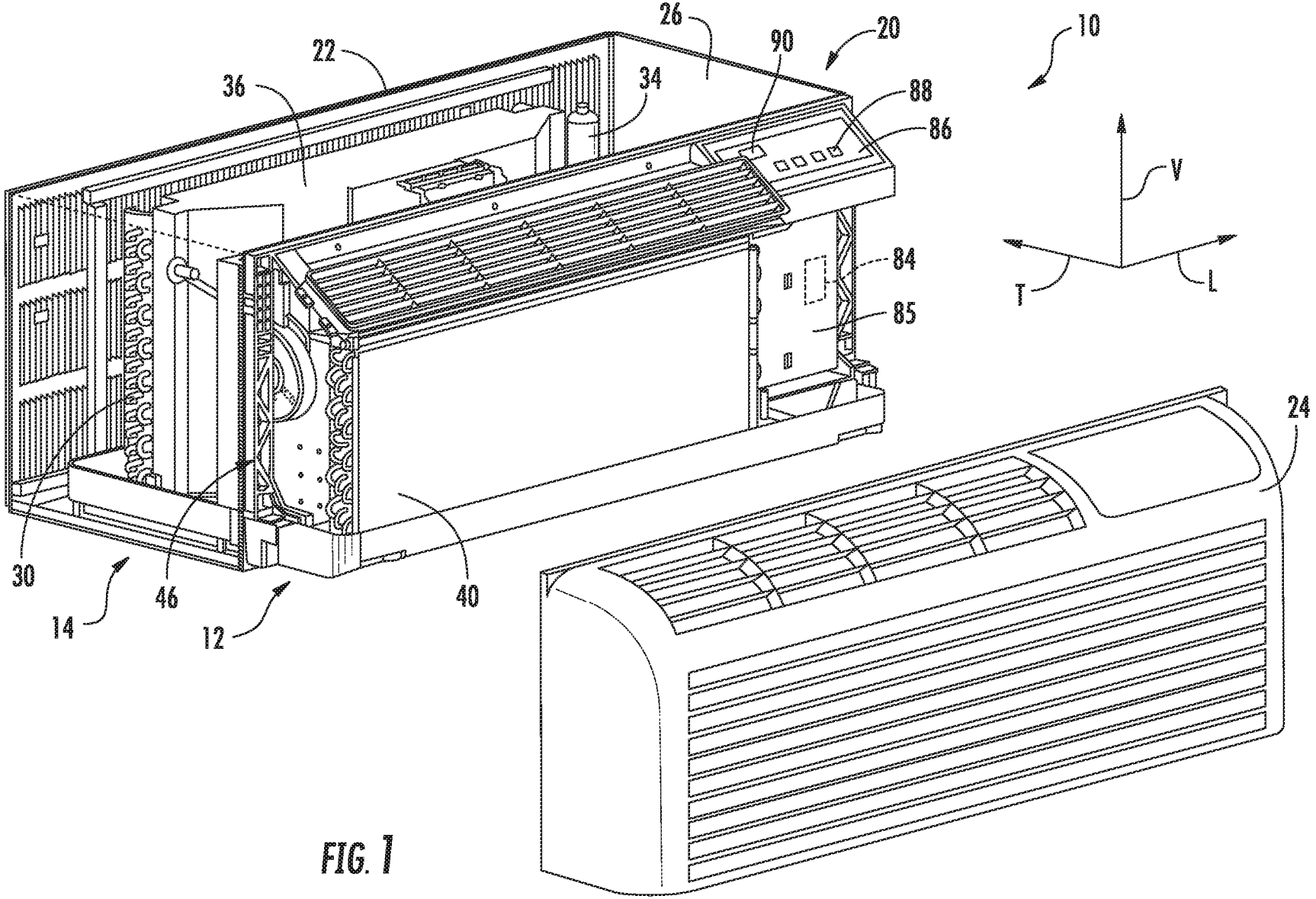
FIG. 1 provides a perspective view of an air conditioner unit, with part of an indoor portion exploded from a remainder of the air conditioner unit for illustrative purposes, in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. Furthermore, as used herein, terms of approximation, such as "approximately," "substantially," or "about," refer to being within a ten percent (10%) margin of error.

FIG. 1 provides a perspective, partially exploded view of an exemplary air conditioner unit 10. The depicted air conditioner unit 10 of FIG. 1 is a one-unit type air conditioner, also conventionally referred to as a room air conditioner or a packaged terminal air conditioner (PTAC). Although the air conditioner unit 10 of FIG. 1 is shown as a PTAC, the inventive aspects disclosed herein are applicable to air conditioning units having different configurations. For instance, the inventive aspects of the present disclosure may apply to packaged terminal units (as noted above), including PTACs and packaged terminal heat pumps (PTHP). Further, the inventive aspects may apply to single package vertical units (SPVU), including single package vertical air conditioners (SPVAC) and single package vertical heat pumps (SPVHP), built ins, window units, etc. Such units may be installed in a window, positioned within an opening of an exterior wall of a building, or some other suitable location. Moreover, for reference, air conditioner unit 10 defines a vertical direction V, a lateral direction L, and a transverse direction T. The vertical, lateral, and transverse directions V, L, T are perpendicular to each other and thus define an orthogonal coordinate system.

As shown in FIG. 1, air conditioner unit 10 has an indoor portion 12 and an outdoor portion 14 separated and defined by a bulkhead 46 of unit 10. Air conditioner unit 10 includes a housing 20 that contains various components. For this embodiment, housing 20 includes a rear grill 22 and a room front 24 spaced from rear grill 22 along the transverse direction T by wall sleeves 26 (only one wall sleeve 26 is shown in FIG. 1). Rear grill 22 is part of the outdoor portion 14 and the room front 24 may be part of the indoor portion 12. Components of the outdoor portion 14, such as an outdoor heat exchanger 30, an outdoor fan 32 (FIG. 3), and a compressor 34 may be housed within the wall sleeve 26 and between rear grill 22 and room front 24. A casing 36 encloses the outdoor fan 32.

Figure 2:
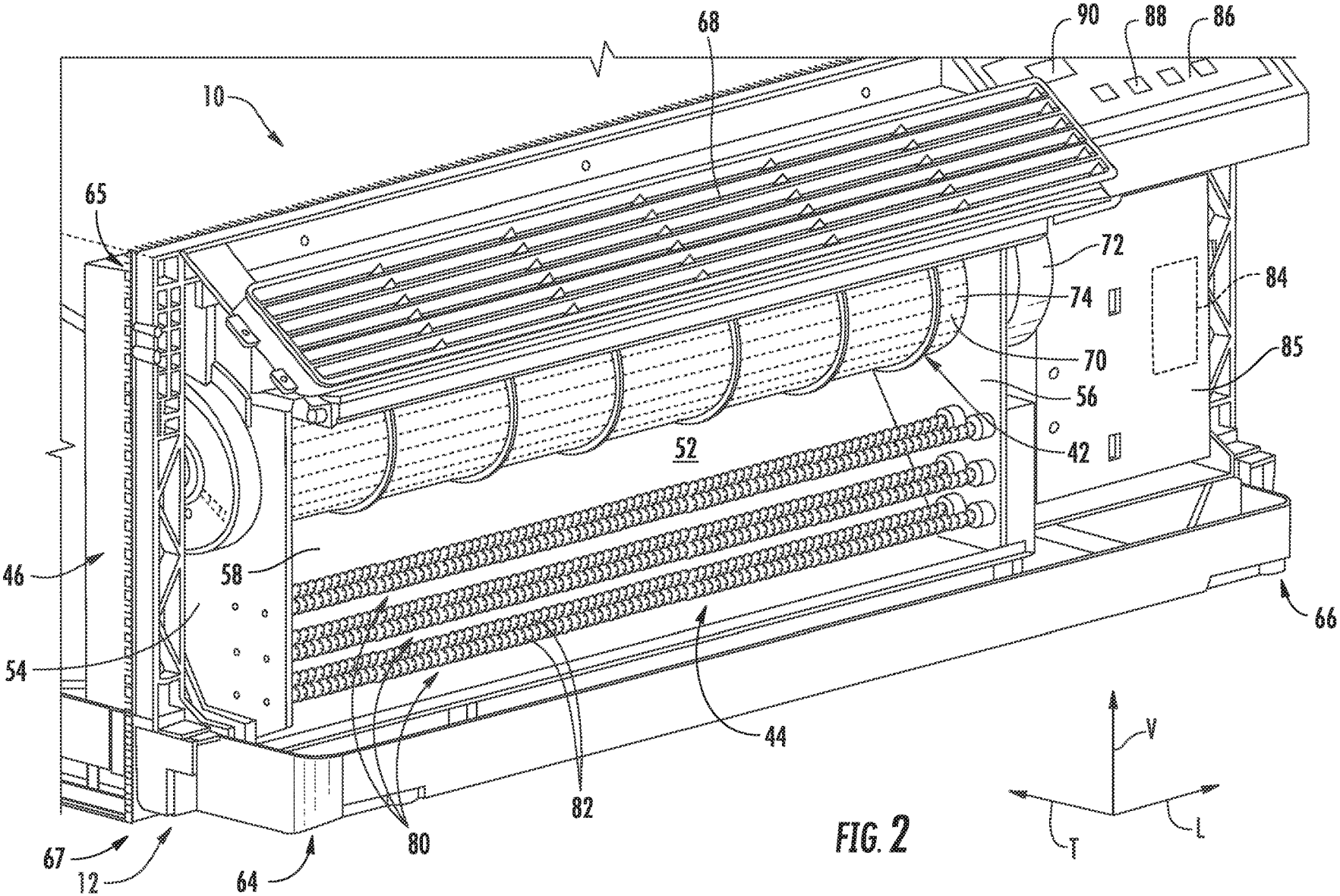
FIG. 2 provides a perspective view of components of an indoor portion of an air conditioner unit in accordance with one exemplary embodiment of the present disclosure.

Referring now to FIGS. 1 and 2, FIG. 2 provides a perspective view of components of indoor portion 12 of air conditioner unit 10. As shown, indoor portion 12 may include an indoor heat exchanger 40 (FIG. 1), a blower fan 42 (FIG. 2), and a heating unit 44 (FIG. 2). These components may, for example, be housed behind the room front 24 (FIG. 1), which has been removed in FIG. 2 for illustrative purposes. Additionally, unit 10 includes bulkhead 46 that generally supports and/or houses various components, such as e.g., the blower fan 42, the heating unit 44, and various electronic components. Bulkhead 46 of unit 10 may generally separate and define indoor portion 12 and outdoor portion 14 of unit 10.

Figure 3:
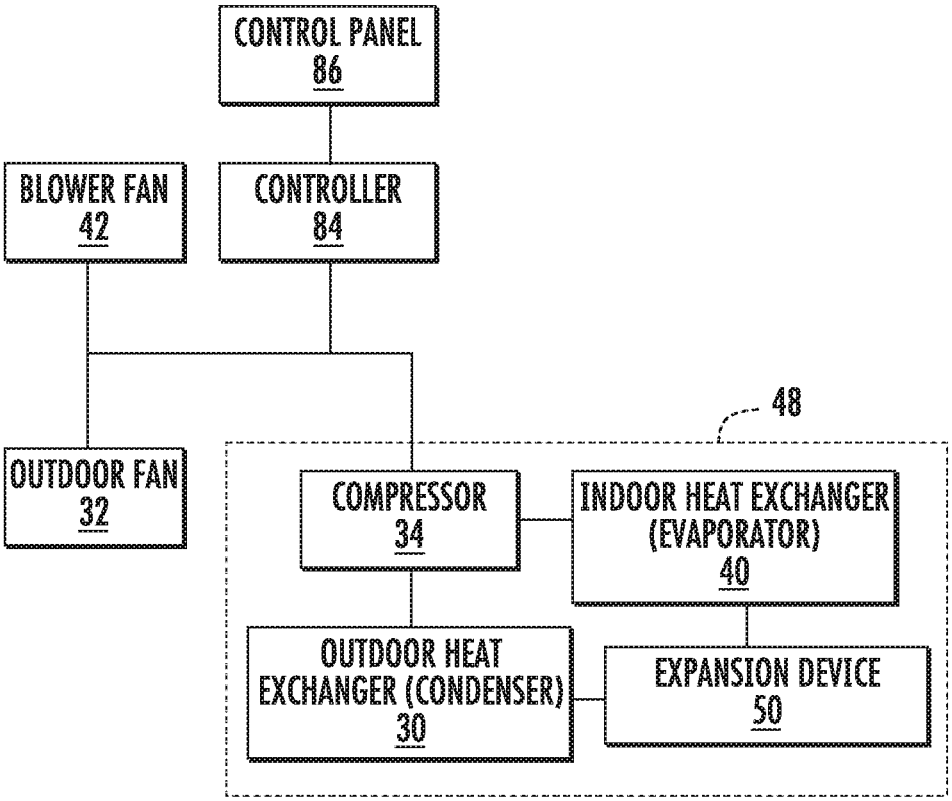
FIG. 3 provides a schematic view of a refrigeration loop in accordance with one embodiment of the present disclosure.

FIG. 3 provides a schematic view of an exemplary refrigeration loop 48 of unit 10 in accordance with one embodiment of the present disclosure. As shown, outdoor and indoor heat exchangers 30, 40 may be components of refrigeration loop 48. For this embodiment, refrigeration loop 48 includes compressor 34 and an expansion device 50. As illustrated, compressor 34 and expansion device 50 are in fluid communication with outdoor heat exchanger 30 and indoor heat exchanger 40 to flow refrigerant therethrough as is generally understood by those of skill in the art. More particularly, in some embodiments, refrigeration loop 48 may include various lines for flowing refrigerant between the various components of refrigeration loop 48 to thus provide fluid communication therebetween. Refrigerant may flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. One suitable refrigerant for use in refrigeration loop 48 is 1,1,1,2-Tetrafluoroethane, also known as R-134A, although it should be understood that the present disclosure is not limited to such example and that any suitable refrigerant may be utilized.

As is understood in the art, refrigeration loop 48 may be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. In contrast, when the assembly is operating in a heating mode and thus performing a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

Referring again to FIG. 2, as shown, bulkhead 46 accommodates a portion of blower fan 42, which may be a centrifugal fan. Alternatively, however, any suitable fan type may be utilized. Blower fan 42 may include a blade assembly 70 and a motor 72. The blade assembly 70, which may include one or more blades disposed within a fan housing 74, may be disposed at least partially within bulkhead 46. As depicted, blade assembly 70 may extend along the lateral direction L between a first sidewall 54 and a second sidewall 56. The motor 72 may be connected to the blade assembly 70, such as through housing 74 to the blades via a shaft. Operation of motor 72 may rotate the blades, thus generally operating blower fan 42. Further, in some exemplary embodiments, motor 72 may be disposed exterior to bulkhead 46. Accordingly, the shaft may extend through second sidewall 56 to connect motor 72 and blade assembly 70.

In some embodiments, outdoor fan 32 (FIG. 3) and blower fan 42 are variable speed fans. For example, motor 72 of blower fan 42 may be configured to rotate blade assembly 70 at different rotational speeds, thereby generating different airflow rates through blower fan 42. Likewise, although not shown, outdoor fan 32 may be operatively coupled with a motor that is configured to drive outdoor fan 32. It may be desirable to operate fans 32, 42 at less than their maximum rated speed to ensure safe and proper operation of refrigeration loop 48 (FIG. 3) at less than its maximum rated speed, e.g., to reduce noise when full speed operation is not needed. Blower fan 42 may operate as an evaporator fan in refrigeration loop 48 (FIG. 3) to encourage the flow of air through indoor heat exchanger 40 (FIG. 1). Accordingly, blower fan 42 may be positioned downstream of indoor heat exchanger 40 along the flow direction of indoor air and downstream of heating unit 44 along the flow direction of outdoor air. Alternatively, blower fan 42 may be positioned upstream of indoor heat exchanger 40 along the flow direction of indoor air, and may operate to push air through indoor heat exchanger 40.

For this embodiment, heating unit 44 includes one or more heater banks 80. Each heater bank 80 may be operated as desired to produce heat. In some embodiments, as shown, three (3) heater banks 80 may be utilized. Alternatively, however, any suitable number of heater banks 80 may be utilized. Each heater bank 80 may further include at least one heater coil or coil pass 82. Alternatively, other suitable heating elements may be utilized.

With reference still to FIG. 2, various features of bulkhead 46 will be more particularly described. As shown, bulkhead 46 extends between a first side 64 (e.g., a left side) and a second side 66 (e.g., a right side) along the lateral direction L and between a top 65 and a bottom 67 along the vertical direction V. Bulkhead 46 includes a partition wall 58 that partitions indoor portion 12 from outdoor portion 14. Partition wall 58 has an indoor surface 60 (FIG. 5) facing indoor portion 12 and an opposing outdoor surface 62 (FIG. 5) facing outdoor portion 14. Bulkhead 46 also includes various surfaces that define an interior 52 thereof. For instance, bulkhead 46 may include first sidewall 54 and second sidewall 56 spaced apart from each other along the lateral direction L. Partition wall 58 extends laterally between the first and second sidewalls 54, 56 and extends to second side 66 of bulkhead 46 (as shown best in FIGS. 4 and 5). Bulkhead 46 may additionally include an air diverter 68 that extends between the first and second sidewalls 54, 56 along the lateral direction L and which may flow air therethrough.

Operation of air conditioner unit 10, including compressor 34 (and thus refrigeration loop 48 generally (FIG. 3)), blower fan 42, outdoor fan 32 (FIG. 3), heating unit 44, expansion device 50, and other components of refrigeration loop 48 may be controlled by a processing device, such as e.g., a controller 84. Controller 84 may be in communication (via for example a suitable wired or wireless connection) with such components of air conditioner unit 10. By way of example, controller 84 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor. Controller 84 may be positioned within a control box enclosure 63 defined between a removable panel 85 and partition wall 58. Further, controller 84 may be one component of many electrical components of control board 83 (FIG. 5).

As shown further in FIG. 2, unit 10 may additionally include a control panel 86 and one or more user inputs 88, which may be included in control panel 86. The user inputs 88 may be in communication with controller 84. A user of the unit 10 may interact with the user inputs 88 to operate unit 10, and user commands may be transmitted between the user inputs 88 and controller 84 to facilitate operation of the unit 10 based on such user commands. A display 90 may additionally be provided in control panel 86, and may be in communication with controller 84. Display 90 may, for example be a touchscreen or other text-readable display screen, or alternatively may simply be a light that can be activated and deactivated as required to provide an indication of an event or setting for the unit 10, for example.

Figure 4:
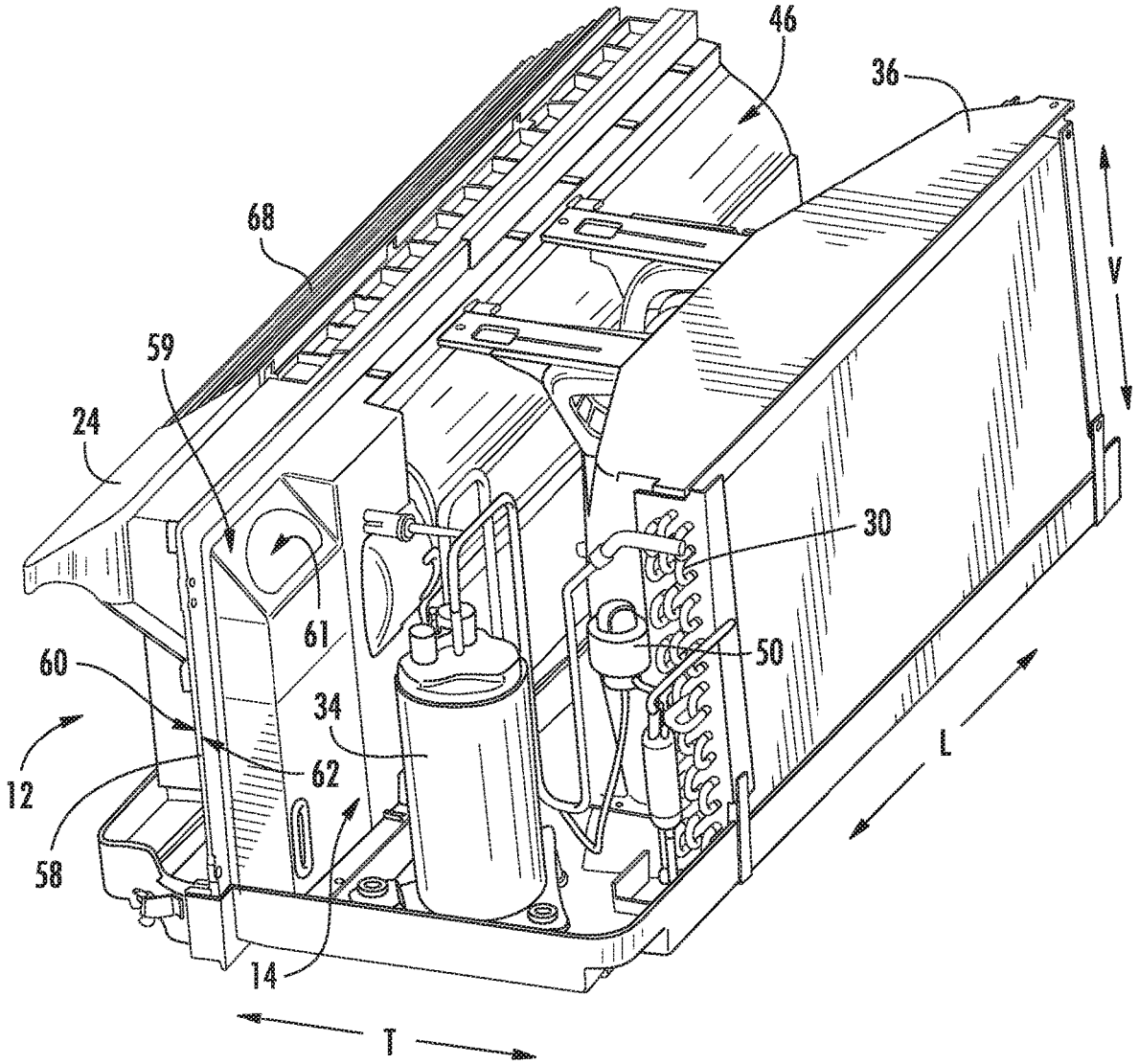
FIG. 4 provides a rear perspective view of a bulkhead of the air conditioner unit of FIG. 1.
Figure 5:
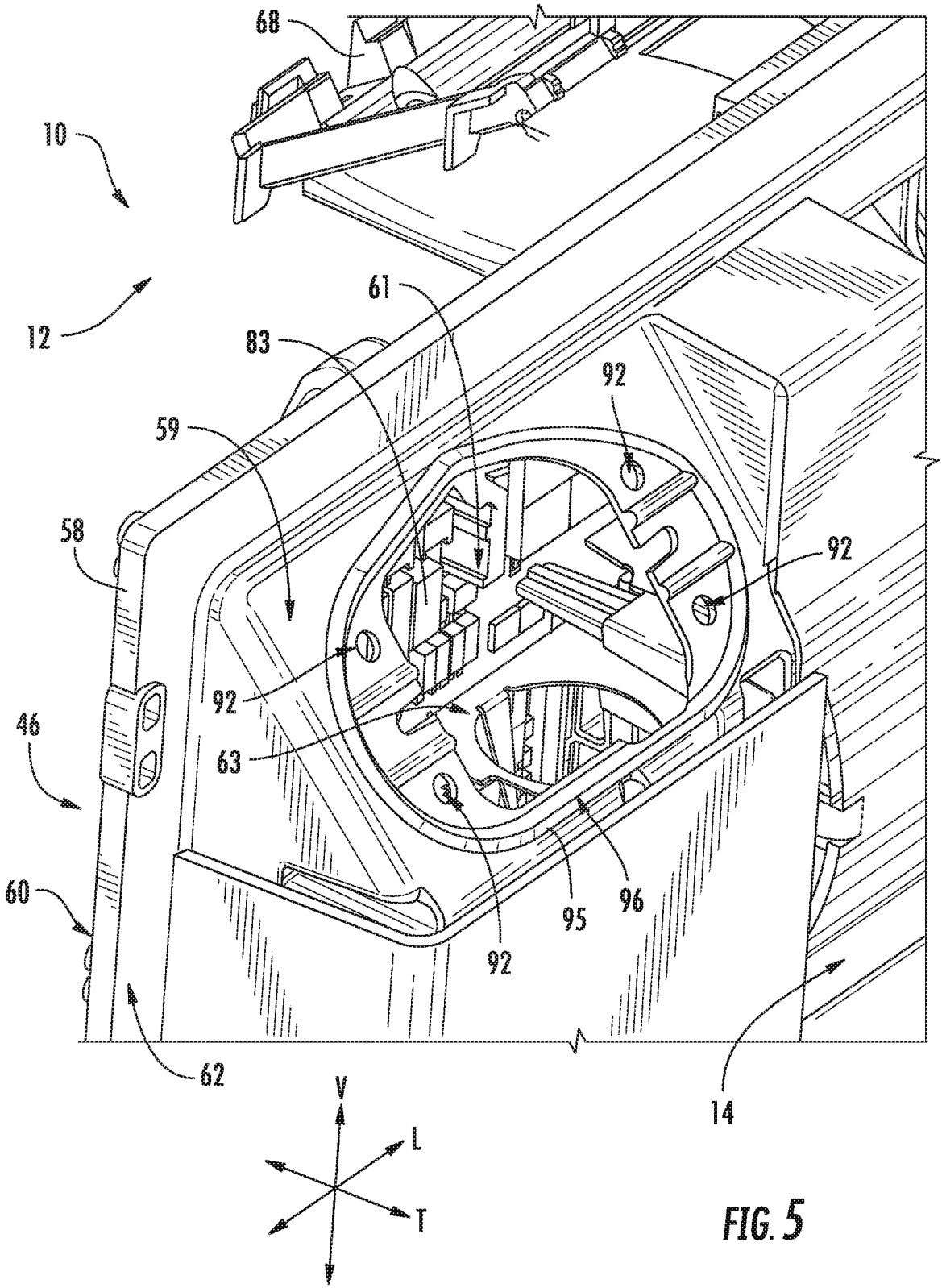
FIG. 5 provides a close up, perspective view of an opening in the bulkhead in accordance with one embodiment of the present disclosure.

FIGS. 4 and 5 provide various views of bulkhead 46. In particular, FIG. 4 provides a rear perspective view of bulkhead 46 of air conditioner unit 10 and FIG. 5 provides a close up, perspective view of bulkhead 46. As shown in FIGS. 4 and 5, partition wall 58 of bulkhead 46 defines an opening 61. In particular, partition wall 58 has an angled portion 59 that defines opening 61. Notably, angled portion 59 of partition wall 58 is angled with respect to the vertical direction V. For instance, for this embodiment, angled portion 59 of partition wall 58 is angled with respect to the vertical direction V by about thirty degrees (30°). In some embodiments, angled portion 59 of partition wall 58 is angled with respect to the vertical direction V by at least thirty degrees (30°). As angled portion 59 of partition wall 58 is angled with respect to the vertical direction V, opening 61 is also defined at an angle with respect to the vertical direction V, e.g., at the same angle. Advantageously, the angled opening 61 defined by angled portion 59 of partition wall 58 allows a user to more easily access enclosure 63. In this way, a user may easily and readily insert components, such as a capacitor and other electronic components, through opening 61 and into enclosure 63. As opening 61 is at an angle with respect to the vertical direction V, the components for mounting the electronic components therein are more visible and mounting is made more ergonomic. Further, the positioning of the opening 61 allows for components to be mounted from the outdoor portion 14 or back side of unit 10 and even if removable panel 85 (FIG. 2) is mounted on unit 10 to enclose the electronic components within enclosure 63. Accordingly, controller 84, main board 83, and other components may be assembled from the outdoor portion 14. It will be appreciated that it is undesirable for water to leak or seep into enclosure 63 which houses or contains various electronic components. Accordingly, in accordance with exemplary aspects of the present disclosure, air conditioner unit 10 includes a cover assembly for covering opening 61 of bulkhead 46 as will be explained below.

Figure 6:
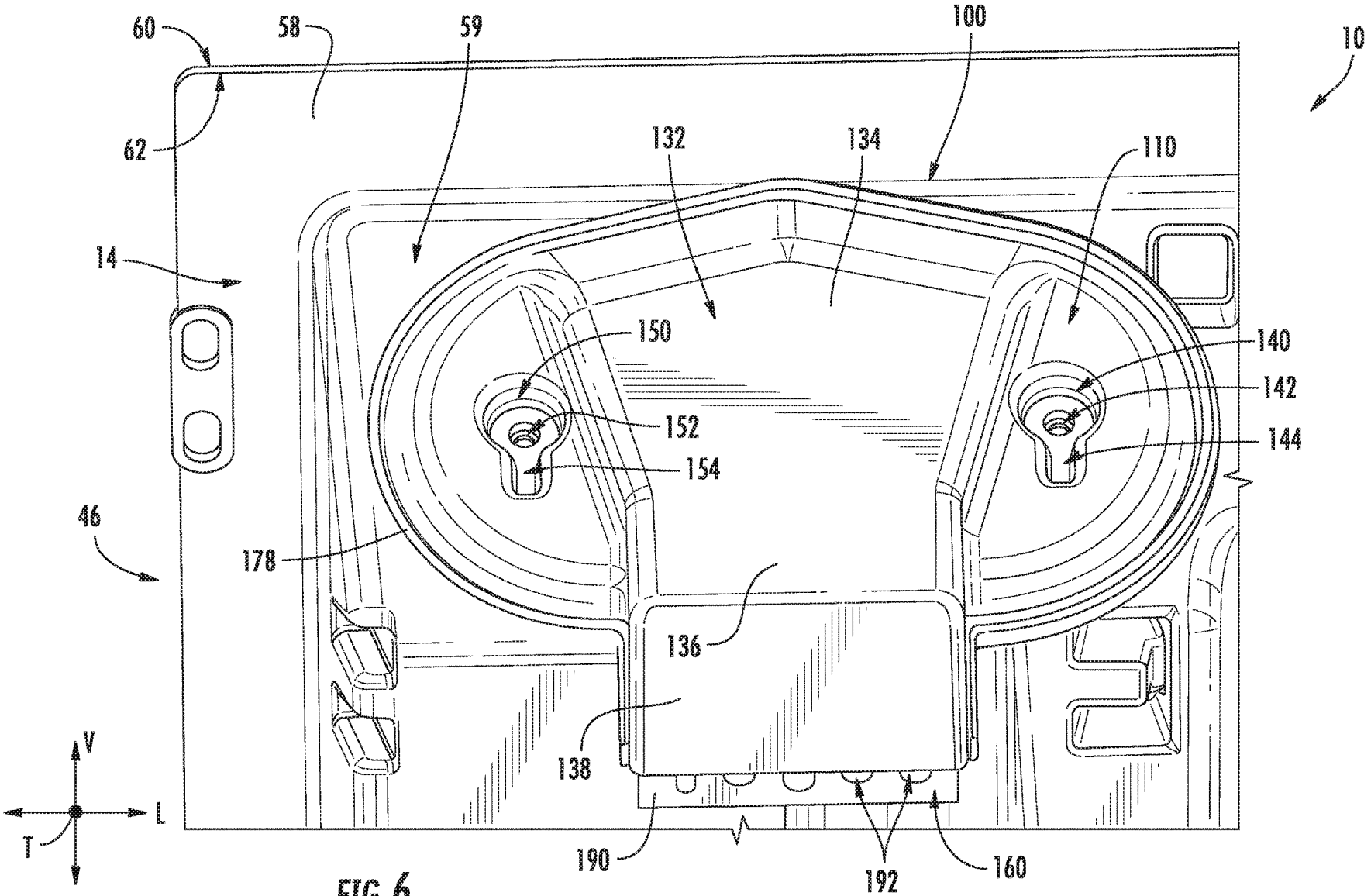
FIG. 6 provides a close up perspective view of an exemplary cover assembly covering the opening of bulkhead of FIG. 5.
Figure 7:
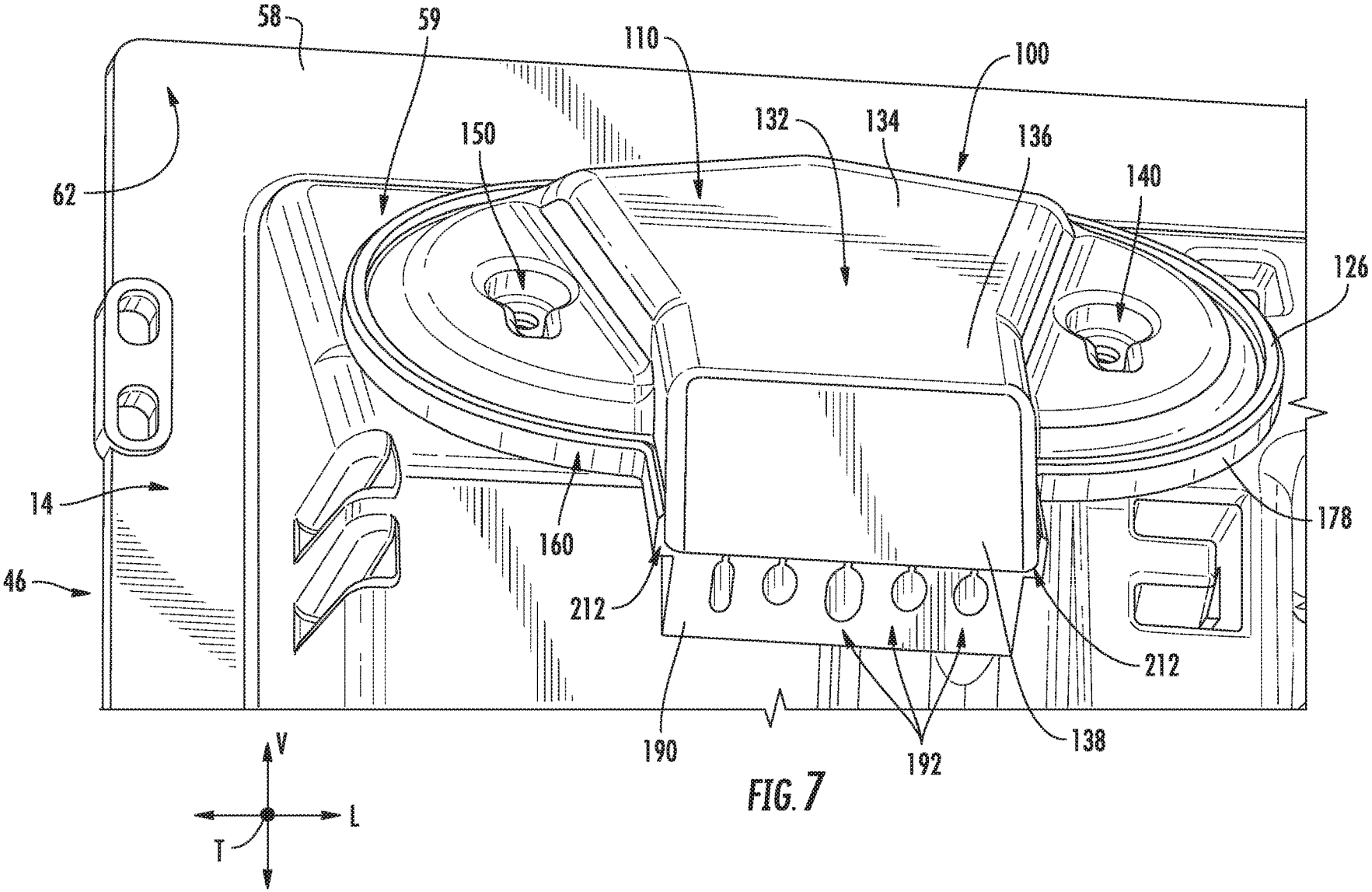
FIG. 7 provides another close up, perspective view of the cover assembly of FIG. 6.
Figure 8:
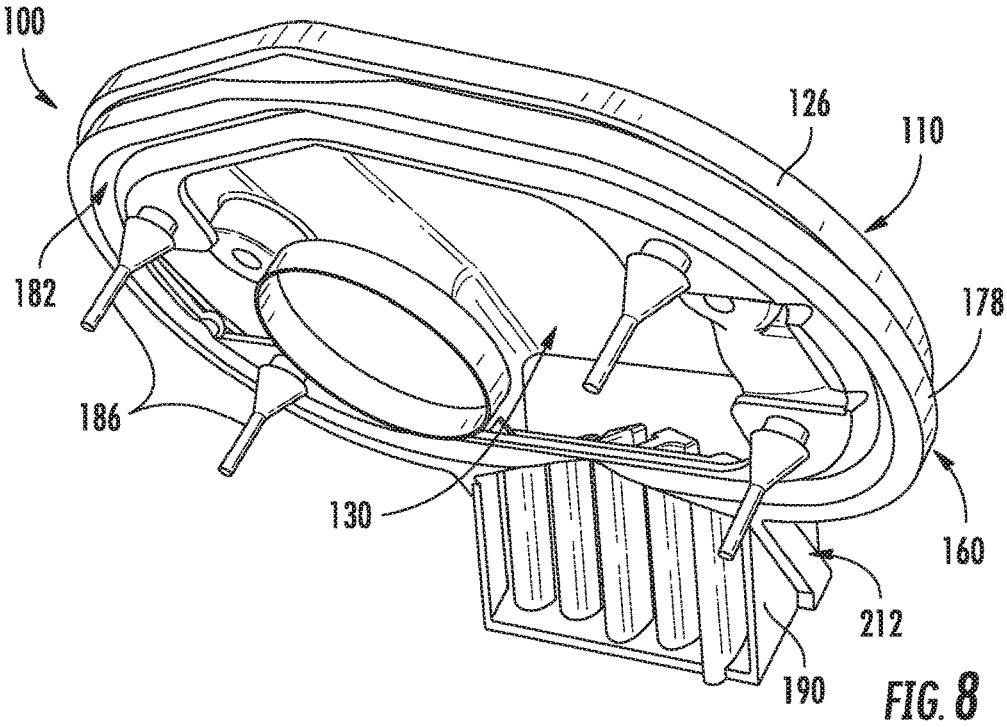
FIG. 8 provides a perspective view of the cover assembly of FIG. 6.
Figure 9:
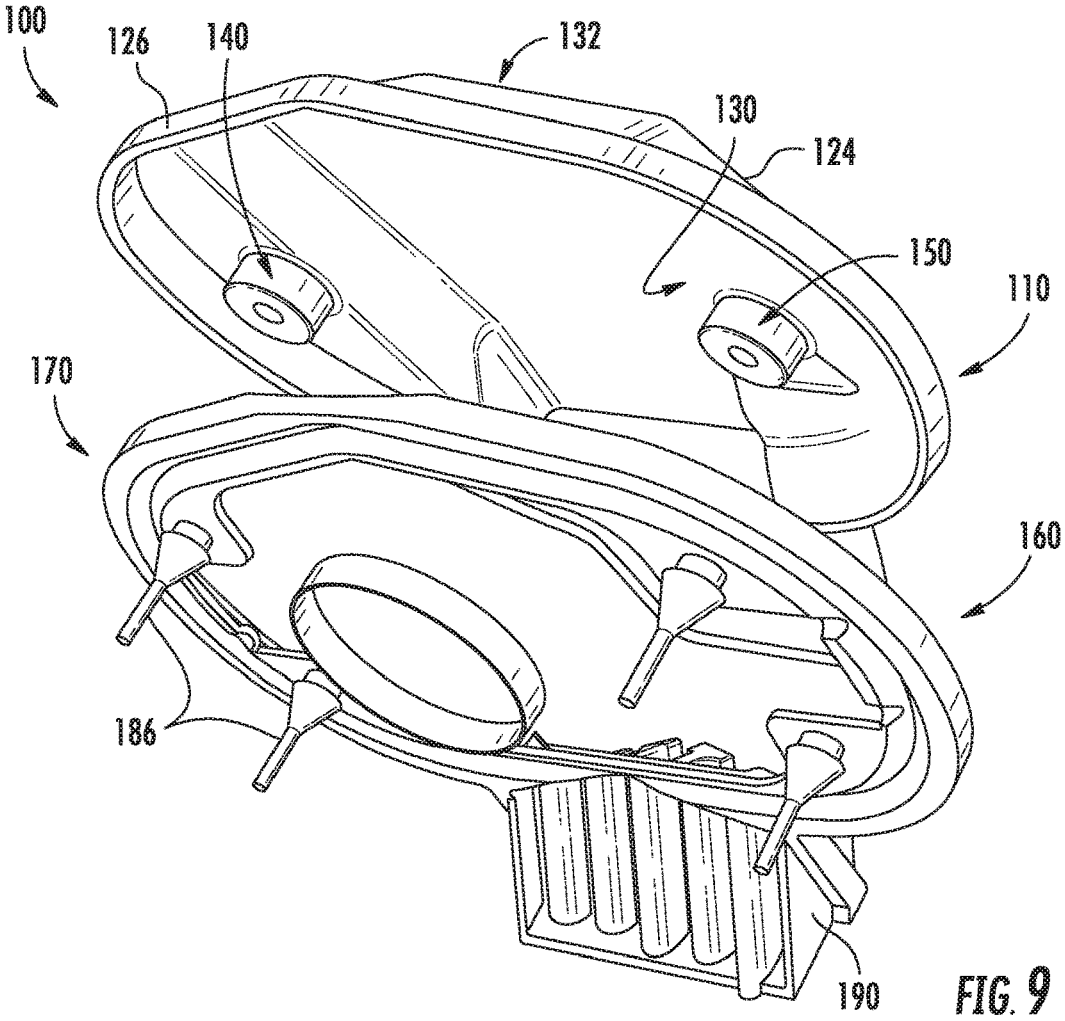
FIG. 9 provides an exploded view of the cover assembly of FIG. 6.
Figure 10:
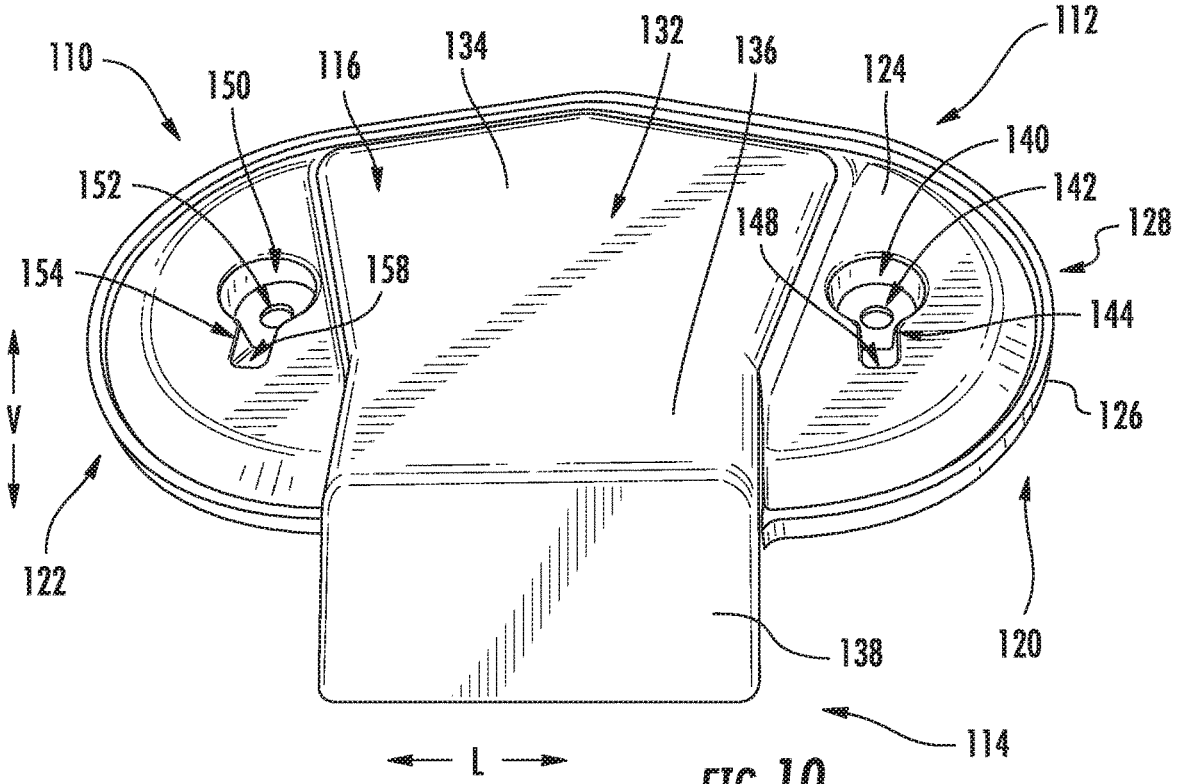
FIG. 10 provides a perspective view of an outer surface of a cover of the cover assembly of FIG. 6.
Figure 11:
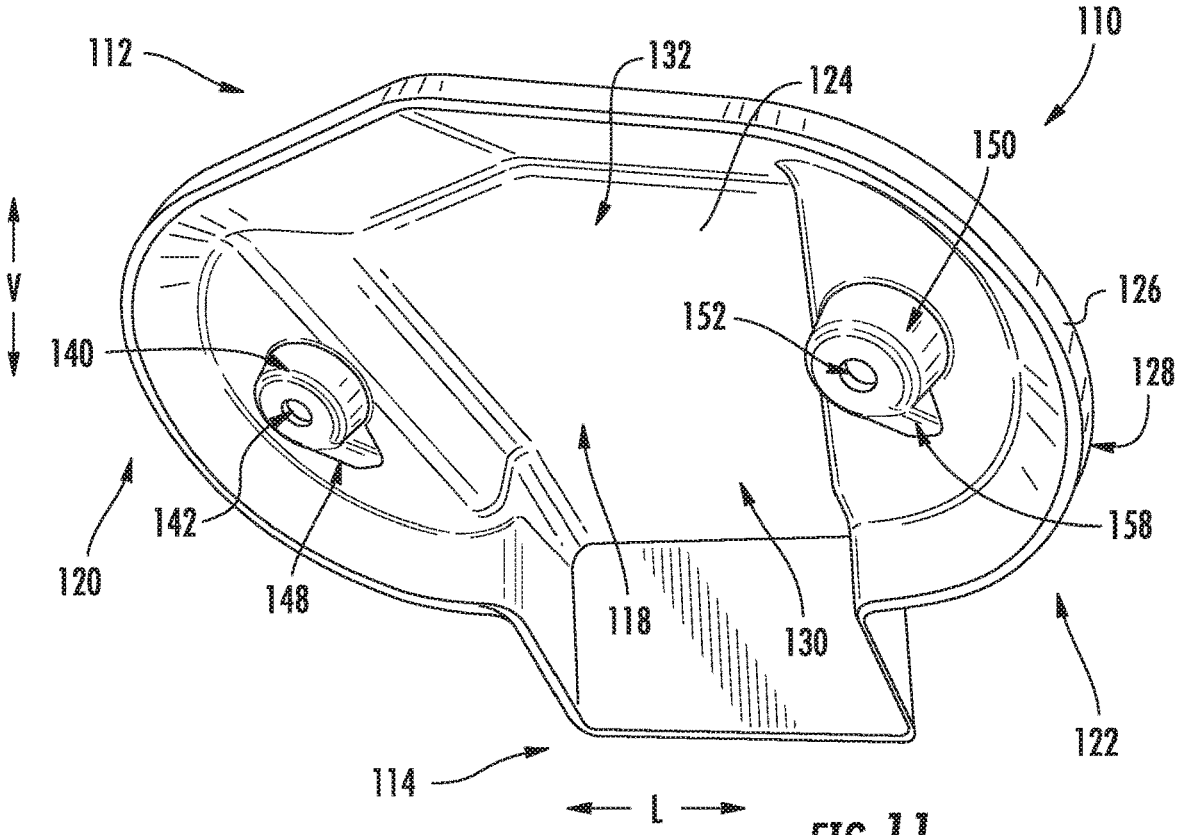
FIG. 11 provides a perspective view of an inner surface of the cover of the cover assembly of FIG. 6.
Figure 12:
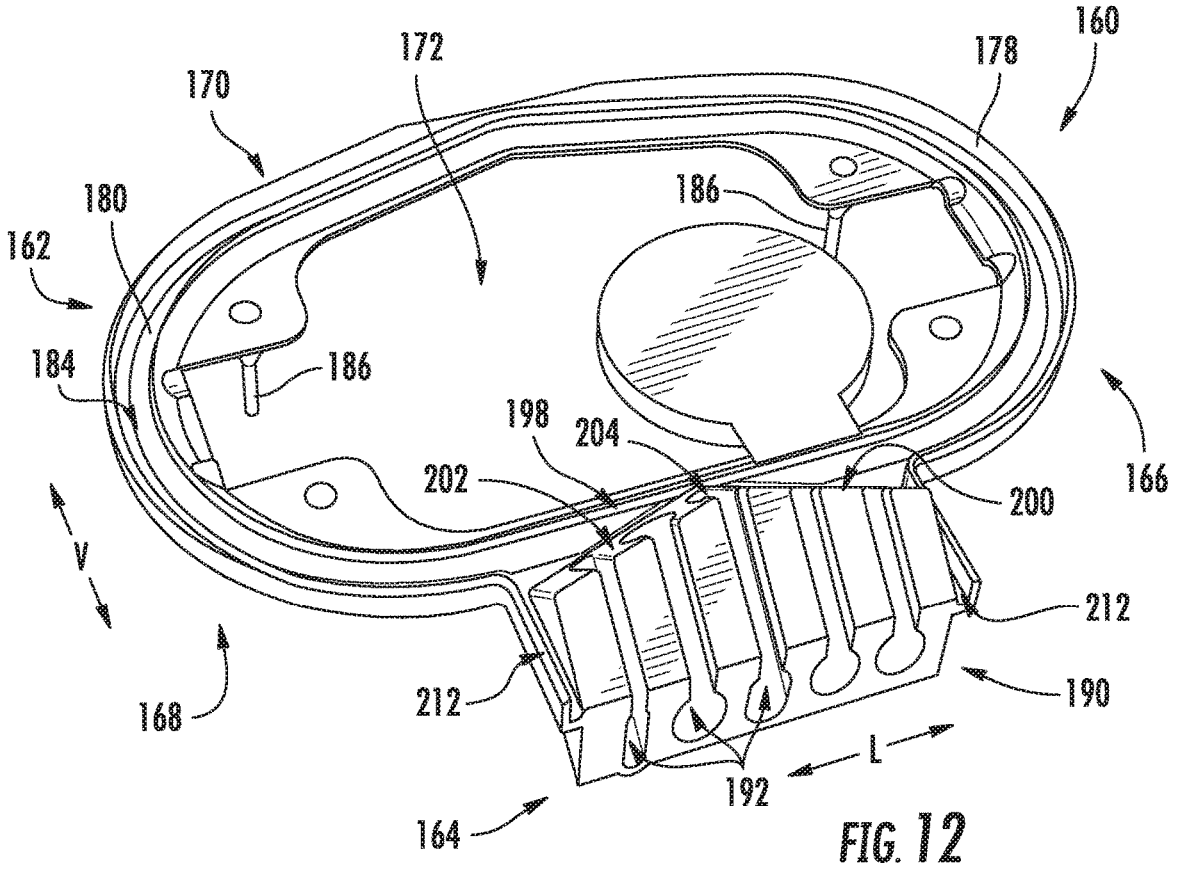
FIG. 12 provides a perspective view of a gasket of cover assembly of FIG. 6.
Figure 13:
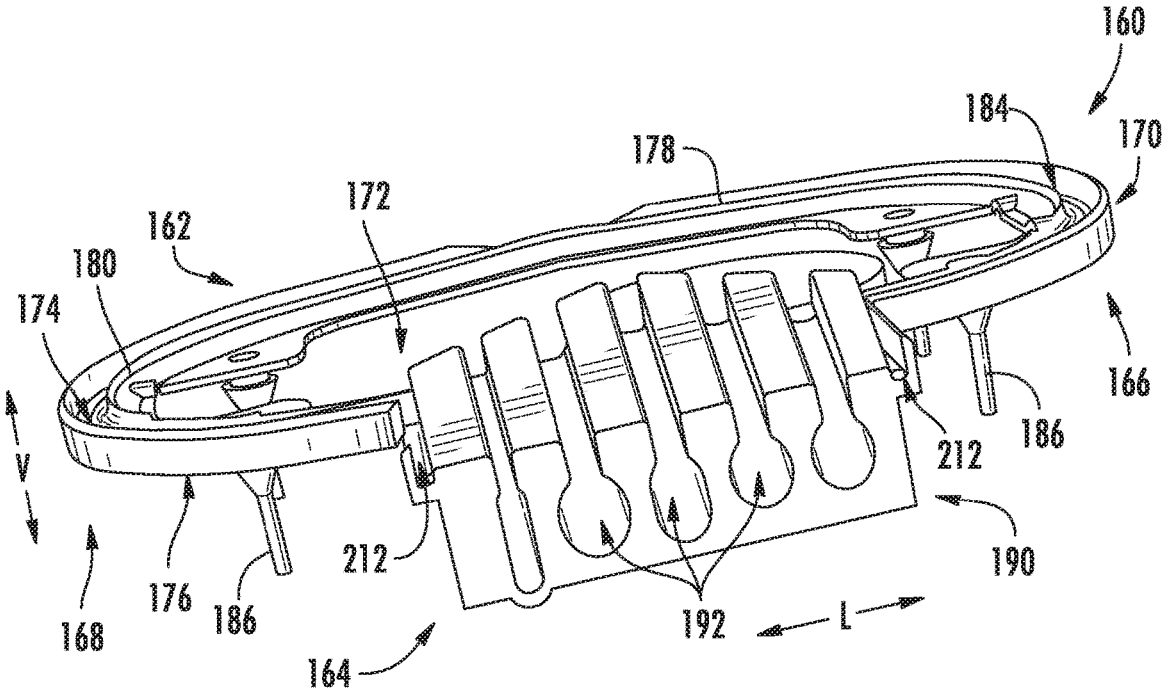
FIG. 13 provides another perspective view of the gasket of the cover assembly of FIG. 6.
Figure 14:
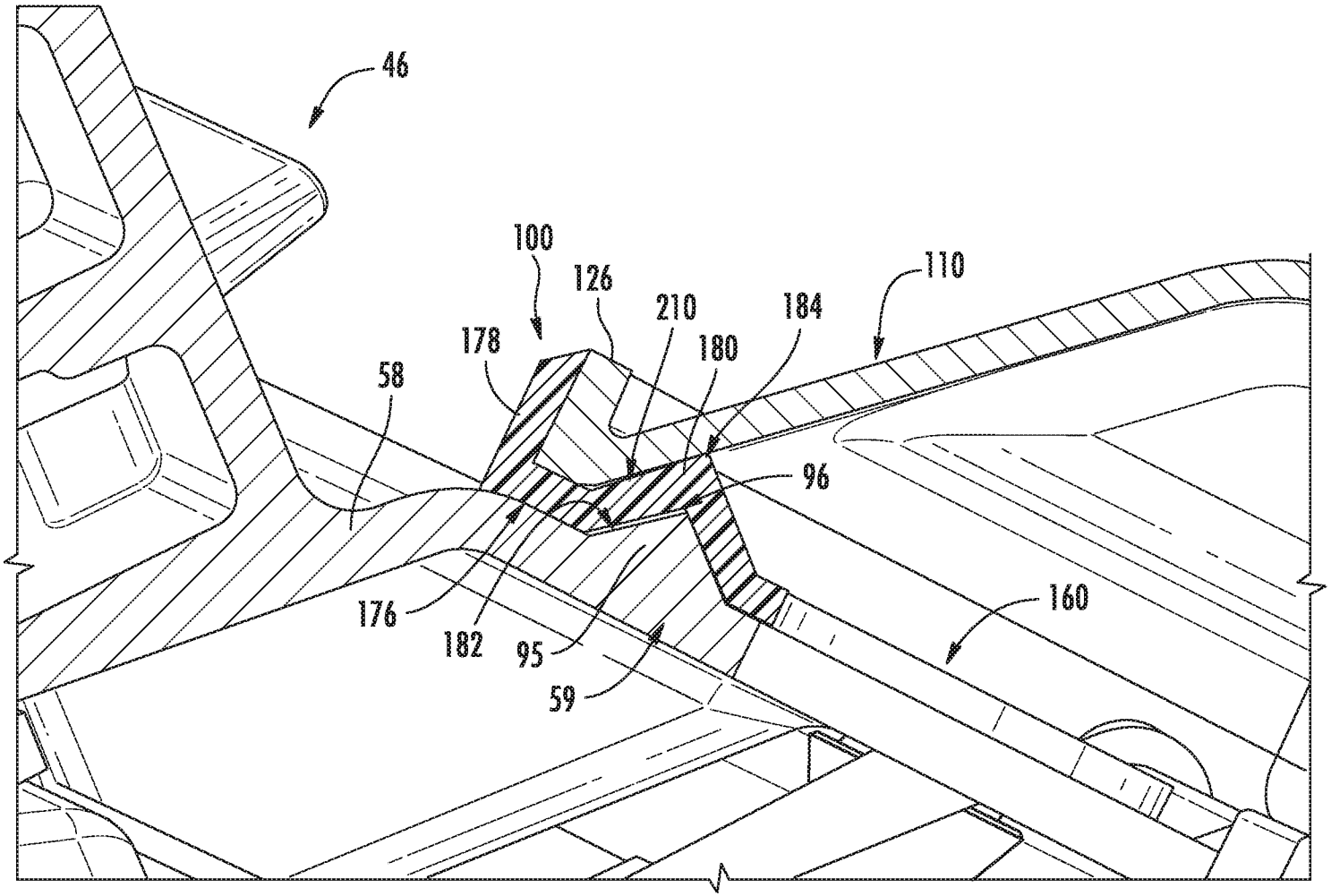
FIG. 14 provides a close up, perspective cross-sectional view of the cover assembly of FIG. 6 mounted to the bulkhead of FIG. 5.
Figure 15:
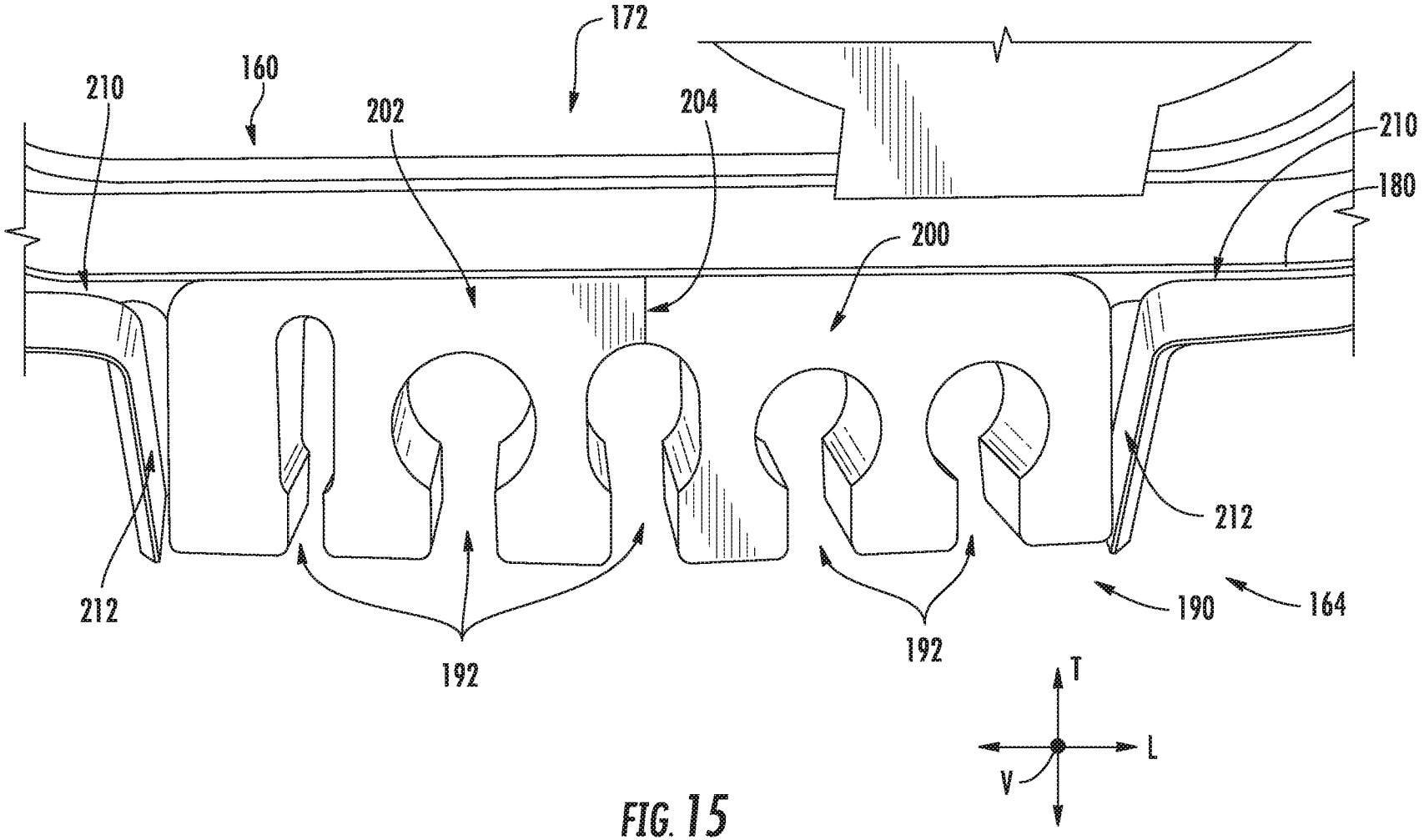
FIG. 15 provides a close up view of the gasket of the cover assembly of FIG. 6 depicting drain passages defined by the gasket.

FIGS. 6 through 15 provide various views of an exemplary cover assembly 100 and components thereof. In particular, FIG. 6 provides a perspective view of cover assembly 100 covering opening 61 (FIG. 5) in bulkhead 46. FIG. 7 provides another perspective view of cover assembly 100 covering opening 61. FIG. 8 provides a perspective view of cover assembly 100. FIG. 9 provides an exploded view of cover assembly 100. FIG. 10 provides a perspective view of an outer surface 116 of a cover 110 of cover assembly 100. FIG. 11 provides a perspective view of an inner surface 118 of cover 110. FIG. 12 provides a perspective view of a gasket 160 of cover assembly 100. FIG. 13 provides another perspective view of gasket 160 of cover assembly 100. FIG. 14 provides a close up, perspective cross-sectional view of cover assembly 100 mounted to bulkhead 46. Finally, FIG. 15 provides a close up view of gasket 160 depicting drain passages defined by gasket 160.

As shown in FIGS. 6 and 7, cover assembly 100 fits over or may be positioned to cover opening 61 (FIG. 5) of bulkhead 46. Cover assembly 100 is removably mountable to bulkhead 46. In this way, a user may remove cover assembly 100 to access, service, or assemble components within or into enclosure 63 (FIG. 5) via opening 61, e.g., from the outdoor side or outdoor portion 14 of unit 10. After accessing, servicing, or assembling components within or into enclosure 63, a user may then mount cover assembly 100 to bulkhead 46 to cover opening 61. As will be explained more fully below, cover assembly 100 includes features for sealing opening 61, e.g., to prevent water from leaking or seeping into enclosure 63. Generally, cover assembly 100 includes cover 110 and gasket 160. When cover assembly 100 is assembled and mounted to wall 58 of bulkhead 46, gasket 160 is disposed between cover 110 and outdoor surface 62 of wall 58, or more particularly, angled portion 59 of wall 58. Cover 110 and gasket 160 are described in detail below.

As shown best in FIGS. 10 and 11, cover 110 of cover assembly 100 (FIGS. 6, 7, 8, 9) extends between a top end 112 and a bottom end 114, e.g., along the vertical direction V. Cover 110 also has outer surface 116 and opposing inner surface 118. Generally, when cover assembly 100 is mounted to bulkhead 46 to cover opening 61 (as shown in FIGS. 6 and 7), outer surface 116 of cover 110 faces outdoor portion 14 of unit 10 and inner surface 118 of cover 110 faces inward toward opening 61 and enclosure 63, or more generally, indoor portion 12 of unit 10. In addition, cover 110 extends between a first side 120 and a second side 122, e.g., along the lateral direction L. Cover 110 may be formed of any suitable material. For instance, for this embodiment, cover 110 is formed of a plastic material.

Cover 110 has a body 124 and a flange 126 extending from body 124 along an outer periphery 128 of cover 110. Particularly, flange 126 projects or extends inward, e.g., towards opening 61 and enclosure 63, from body 124. Body 124 and flange 126 together define an interior volume 130 of cover 110. At least a portion of gasket 160 may be received within interior volume 130 of cover 110 (as shown in FIG. 8), as will be explained in more detail herein.

Body 124 of cover 110 has a ramp portion 132 that extends between top end 112 and the bottom end 114 of cover 110. As depicted, ramp portion 132 has one more angled surfaces that are angled with respect to the vertical direction V. For instance, as shown in FIG. 10, the one or more angled surfaces of ramp portion 132 include a top ramp surface 134 angled with respect to the vertical direction V, a middle ramp surface 136 angled with respect to the vertical direction V, and a bottom ramp surface 138 extending substantially parallel with the vertical direction V. The top ramp surface 134 has a steeper slope or angle than the middle ramp surface 136. Top ramp surface 134 is contiguous with middle ramp surface 136 and bottom ramp surface 138 is contiguous with middle ramp surface 136. Advantageously, ramp portion 132 and its angled surfaces facilitate drainage of liquid, e.g., water, off of cover 110 and away from opening 61 (FIG. 5). Moreover, as will be explained more fully below, bottom ramp surface 138 covers a wire guide 190 (FIGS. 6 and 7) of gasket 160 and one or more wires guided or extending through wire guide 190. Thus, bottom ramp surface 138 of cover 110 prevents water from seeping or leaking onto wires entering opening 61 through wire guide 190 of gasket 160.

As further shown in FIGS. 10 and 11, cover 110 defines one or more screw pockets. For this embodiment, cover 110 defines a first screw pocket 140 positioned on one side of ramp portion 132 and a second screw pocket 150 positioned on the other side of ramp portion 132. Particularly, first screw pocket 140 is positioned proximate first side 120 of cover 110 and second screw pocket 150 is positioned proximate second side 122 of cover 110. First and second screw pockets 140, 150 are recessed within body 124 of cover 110. Cover 110 defines a screw hole 142 concentrically aligned or positioned within first screw pocket 140. Similarly, cover 110 defines a screw hole 152 concentrically aligned or positioned within second screw pocket 150. Although not shown, screws may be driven through screw holes 142, 152 of cover 110 and into bulkhead 46 (FIGS. 6 and 7) to mount or secure cover assembly 100 to bulkhead 46.

Notably, cover 110 defines pocket drains that are configured for draining the screw pockets. Particularly, cover 110 defines a first pocket drain 144 in fluid communication with first screw pocket 140. First pocket drain 144 is configured for draining liquid from first screw pocket 140. First pocket drain 144 is contiguous with first screw pocket 140 and is positioned at a bottom end 146 of first screw pocket 140. First pocket drain 144 has an angled or ramped wall 148 that ushers or facilitates liquid flow from first screw pocket 140 and onto outer surface 116 of cover 110. In this way, liquid is prevented from entering enclosure 63 (FIG. 5) through screw hole 142. Cover 110 also defines a second pocket drain 154 that is similarly configured to first pocket drain 144. As depicted, second pocket drain 154 is in fluid communication with second screw pocket 150. Second pocket drain 154 is configured for draining liquid from second screw pocket 150. Second pocket drain 154 is contiguous with second screw pocket 150 and is positioned at a bottom end 156 of second screw pocket 150. Second pocket drain 154 has an angled or ramped wall 158 that ushers or facilitates liquid flow from second screw pocket 150 and onto outer surface 116 of cover 110. In this way, liquid is prevented from entering enclosure 63 (FIG. 5) through screw hole 152.

As shown best in FIGS. 12 and 13, gasket 160 of cover assembly 100 extends between a top end 162 and a bottom end 164, e.g., along the vertical direction V. In addition, gasket 160 extends between a first side 166 and a second side 168, e.g., along the lateral direction L. For this embodiment, gasket 160 has a sealing portion 170 that defines a gasket opening 172. As depicted, sealing portion 170 has a ring or annular shape. Sealing portion 170 has an outer surface 174 and an opposing inner surface 176 (FIG. 13). Generally, when cover assembly 100 is mounted to bulkhead 46 to cover opening 61 (FIG. 5), outer surface 174 of sealing portion 170 faces outdoor portion 14 of unit 10 and inner surface 176 of sealing portion 170 faces inward toward opening 61 and enclosure 63 (FIG. 5), or more generally, indoor portion 12 of unit 10. For this embodiment, gasket 160 is a molded silicone gasket. However, gasket 160 may be formed of other suitable materials as well.

Notably, sealing portion 170 of gasket 160 defines a gasket bead 180 projecting outward therefrom. Particularly, gasket bead 180 projects outward from outer surface 174 of sealing portion 170. Generally, gasket bead 180 has a triangular cross section. However, in alternative embodiments, gasket bead 180 may have other suitable cross section shapes. Gasket bead 180 extends at least partially around gasket opening 172 of sealing portion 170. For this embodiment, as depicted best in FIG. 12, gasket bead 180 extends entirely around gasket opening 172 of sealing portion 170. Further, sealing portion 170 of gasket 160 defines an outer flange 178 extending at least partially around gasket opening 172 of sealing portion 170. Outer flange 178 projects outward (i.e., away from opening 61) from outer surface 174 at an outer periphery of sealing portion 170 and is spaced from gasket bead 180. As shown in FIGS. 6, 7, and 14, when cover assembly 100 is assembled and mounted to bulkhead 46, flange 126 of cover 110 is in sealing engagement with outer flange 178 of gasket 160. As best shown in FIG. 14, in some embodiments, flange 126 of cover 110 may have a draft angle of about five degrees (5°) such that an interference fit is made between flange 126 and outer flange 178 of gasket 160.

As further depicted in FIGS. 12 and 13, wire guide 190 of gasket 160 extends from sealing portion 170 to bottom end 164 of gasket 160. Wire guide 190 defines one or more wire passages 192 that are configured to guide and seal various wires extending therethrough, e.g., from outdoor portion 14 into enclosure 63 (FIG. 5). For this embodiment, wire guide 190 defines a plurality of wire passages 192 that are spaced from one another along the lateral direction L. The wire passages 192 may be of different dimensions and shapes to accommodate different types of wires. Each wire passage 192 extends between an exterior end 194 and an interior end 196. The exterior ends 194 of wire passages 192 are defined by wire guide 190 at or proximate bottom end 164 of gasket 160. The interior ends 196 of wire passages 192 are defined by wire guide 190 at a top portion 198 of wire guide 190 or at or proximate gasket opening 172 defined by sealing portion 170 of gasket 160. Wire passages 192 extends substantially along the vertical direction V. Moreover, as shown best in FIG. 12, top portion 198 of wire guide 190 has a first angled surface 200 that is sloped downward along the vertical direction V from the middle of wire guide 190 to a first side of wire guide 190 and a second angled surface 202 that is sloped downward along the vertical direction V from the middle of wire guide 190 to a second side of wire guide 190. Accordingly, first angled surface 200 and second angled surface 202 of top portion 198 slope in opposite directions and form a ridge 204 at the middle of wire guide 190 (see also FIG. 15). Thus, as shown, top portion 198 of wire guide 190 has a gable construction. The gable construction of top portion 198 facilitates and encourages liquid that has seeped or leaked into or around wire guide 190 to exit gasket 160.

With reference now to FIGS. 5 and 14, as shown, wall 58 defines a bulkhead bead 95 projecting outward from outdoor surface 62 and extending at least partially around opening 61. For this embodiment, bulkhead bead 95 projecting outward from outdoor surface 62 of wall 58 extends entirely around opening 61. Generally, bulkhead bead 95 projects from outdoor surface 62 around the perimeter of opening 61. Further, bulkhead bead 95 has a triangular cross section. However, in alternative embodiments, bulkhead bead 95 may have other suitable cross sections.

With reference to FIGS. 5, 8 and 9, as shown, sealing portion 170 of gasket 160 defines one or more alignment posts 186 projecting inward therefrom (FIGS. 8 and 9). For this exemplary embodiment, sealing portion 170 of gasket 160 defines a plurality of alignment posts 186 projecting therefrom. Particularly, gasket 160 include four (4) alignment posts 186 that are each insertable into an associated alignment opening 92 defined by wall 58 of bulkhead 46 (FIG. 5). In this manner, to mount gasket 160 onto bulkhead 46, the alignment posts 186 are each inserted into their respective or associated alignment openings 92 and extend into enclosure 63. In this way, gasket 160 may be properly aligned with opening 61. After gasket 160 is positioned in place over opening 61, cover 110 may be onto gasket 160 and secured to bulkhead 46 in a manner described more fully below.

As shown in FIG. 14, when cover assembly 100 is mounted to bulkhead 46 to cover opening 61, gasket 160 is disposed between cover 110 and outdoor surface 62 of wall 58. Particularly, inner surface 176 of sealing portion 170 is in sealing engagement with outdoor surface 62 of wall 58 and outer surface 174 of sealing portion 170 is in sealing engagement with cover 110. Further, as depicted, gasket 160 is in sealing engagement with the bulkhead bead 95 of bulkhead 46 and gasket bead 180 is in sealing engagement with cover 110. As bulkhead bead 95 and gasket bead 180 extend around the entirety of opening 61, liquid is prevent from seeping or leaking into opening 61. In this way, the components within enclosure 63 are protected. Notably, when cover 110 is secured to gasket 160 and mounted on bulkhead 46 over opening 61 (e.g., by driving screws into screw holes 142, 152 (FIG. 10)), cover 110 compresses gasket 160 against wall 58 of bulkhead 46 to ensure sealing engagement between bulkhead 46 and gasket 160 as well as between gasket 160 and cover 110.

For this embodiment, gasket bead 180 projecting outward from sealing portion 170 of gasket 160 is substantially aligned with bulkhead bead 95 projecting outward from wall 58 of bulkhead 46. That is, a ridge 96 of bulkhead bead 95 that forms the outer most point of bulkhead bead 95 is substantially aligned with a ridge 184 that forms the outer most point of gasket bead 180, e.g., along an axial direction A that extends in a direction orthogonal to angled portion 59 of wall 58. Stated differently, ridge 96 of bulkhead bead 95 is substantially aligned with ridge 184 of gasket bead 180 when they point or extend in the same direction, e.g., the axial direction A. Accordingly, in some embodiments, gasket bead 180 projecting outward from sealing portion 170 of gasket 160 is substantially axially aligned with bulkhead bead 95 projecting outward from wall 58 of bulkhead 46. Stacking the beads 95, 180 one on top of another facilitates sealing engagement of cover 110 with gasket 160 and creates a more tortuous path for water to enter opening 61. Further, as shown in FIG. 14, bulkhead bead 95 extends into and substantially fills a depression 182 defined by gasket bead 180. Aligning the depression 182 of gasket bead 180 with bulkhead bead 95 facilitates alignment of gasket 160 onto bulkhead 46 and also facilitates sealing engagement between gasket 160 and wall 58 of bulkhead 46.

As shown best in FIG. 14, a drain 210 is defined by cover 110 and gasket 160 between the outer flange 178 of gasket 160 and gasket bead 180 projecting outward from sealing portion 170. If liquid (e.g., water) seeps or leaks between gasket 160 and cover 110, drain 210 provides a means for directing the liquid away from opening 61 and dispensing the liquid at bottom end 164 of gasket 160. Generally, drain 210 extends annularly around gasket opening 172 except for along the wire guide 190. As shown best in FIG. 15, liquid collected by drain 210 (cover 110 has been removed for illustrative purposes) may flow toward bottom end 164 of gasket 160 and may exit or be dispensed from gasket 160 by a drain passage 212. As depicted, for this embodiment, gasket 160 defines two (2) drain passages 212. The drain passages 212 are in fluid communication with drain 210 and are defined by wire guide 190. The drain passages 212 are spaced from one another, e.g., along the lateral direction L, and form the end passages of wire guide 190. As best shown in FIG. 12, the drain passages 212 are defined such that they slope downward along the vertical direction V. In this way, liquid is directed out of drain 210, and importantly, away from opening 61. The liquid exiting drain 210 via drain passages 212 may be dispensed into outdoor portion 14 of unit 10. In some embodiments, a conduit may be in fluid communication with the exit ends of the drain passages 212 so that water exiting gasket 160 may be carried to a desired location.

Air conditioner unit 10 and cover assembly 100 described herein provide a number of advantages and benefits. For instance, some or all of the components within enclosure 63 may be accessed and assembled from the back of bulkhead 46 via opening 61, which may facilitate assembly and servicing of unit 10. For example, as depicted in FIGS. 4 and 5, angled portion 59 of partition wall 58 defines opening 61 through which various electrical components may be inserted. In addition, the cover assembly 100 described and illustrated in the figures provides a means for covering opening 61, during operation of unit 10. As detailed above, cover assembly 100 includes features for sealing the perimeter of opening 61. Furthermore, those of skill in the art will appreciate that air conditioner unit 10 and cover assembly 100 may provide other advantages and have other benefits not expressly listed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical direction, the air conditioner unit comprising:

a bulkhead defining an indoor portion and an outdoor portion, the bulkhead having a wall defining an opening and having an indoor surface facing the indoor portion and an outdoor surface facing the outdoor portion, the wall defining a bulkhead bead projecting outward from the outdoor surface and extending at least partially around the opening, the bulkhead bead being formed by a first angled surface and a second angled surface meeting at a ridge; and a cover assembly for covering the opening, the cover assembly comprising:

a cover; and a gasket disposed between the cover and the outdoor surface of the wall and in sealing engagement with the bulkhead bead, the gasket having a sealing portion defining a gasket bead projecting outward therefrom and extending at least partially around the sealing portion such that the gasket bead is in sealing engagement with the cover, and wherein the gasket bead is formed by a first angled surface and a second angled surface that together define a depression, and wherein the bulkhead bead extends into and substantially fills the depression such that the first and second angled surfaces of the bulkhead bead engage the first and second angled surfaces of the gasket bead, respectively.

2. The air conditioner unit of claim 1, wherein the gasket bead projecting outward from the sealing portion of the gasket is axially aligned with the bulkhead bead projecting outward from the wall of the bulkhead.

3. The air conditioner unit of claim 1, wherein the sealing portion of the gasket defines a gasket opening and has an outer surface and an inner surface, wherein the inner surface of the sealing portion is in sealing engagement with the outdoor surface of the wall and the outer surface of the sealing portion is in sealing engagement with the cover.

4. The air conditioner unit of claim 1, wherein the sealing portion of the gasket defines an outer flange extending at least partially around the sealing portion.

5. The air conditioner unit of claim 4, wherein the cover has a flange extending along an outer periphery of the cover, and wherein the flange of the cover is in sealing engagement with the outer flange of the gasket.

6. The air conditioner unit of claim 5, wherein a drain is defined by the cover and the gasket between the outer flange of the gasket and the gasket bead projecting outward from the sealing portion.

7. The air conditioner unit of claim 1, wherein the gasket extends between a top end and a bottom end, and wherein the gasket has a wire guide extending from the sealing portion at the bottom end, and wherein the wire guide defines one or more wire passages.

8. The air conditioner unit of claim 7, wherein the one or more wire passages each extend between an exterior end and an interior end, and wherein the exterior ends of the one or more wire passages are defined by the wire guide at or proximate the bottom end of the gasket and the interior ends of the one or more wire passages are defined by the wire guide at or proximate a gasket opening defined by the sealing portion of the gasket.

9. The air conditioner unit of claim 1, wherein the cover extends between a top end and a bottom end, and wherein the cover has a ramp portion that has one or more angled surfaces that are angled with respect to the vertical direction.

10. The air conditioner unit of claim 9, wherein the one or more angled surfaces of the ramp portion include a top ramp surface angled with respect to the vertical direction, a middle ramp surface angled with respect to the vertical direction, and a bottom ramp surface extending substantially parallel with the vertical direction.

11. The air conditioner unit of claim 1, wherein the bulkhead bead projecting outward from the outdoor surface of the wall extends entirely around the opening.

12. The air conditioner unit of claim 1, wherein the bulkhead bead has a triangular cross section.

13. The air conditioner unit of claim 1, wherein the wall of the bulkhead has an angled portion that is angled with respect to the vertical direction, and wherein the angled portion of the wall defines the opening.

14. The air conditioner unit of claim 13, wherein the angled portion of the wall is angled with respect to the vertical direction by at least thirty degrees (30°).

15. The air conditioner unit of claim 1, further comprising:

a removable panel mounted to the bulkhead such that the removable panel and the wall define an enclosure, and wherein the opening defined by the wall provides access to the enclosure from the outdoor portion of the air conditioner unit.

16. An air conditioner unit defining a vertical direction, the air conditioner unit comprising:

a bulkhead defining an indoor portion and an outdoor portion, the bulkhead having a wall defining an opening and having an indoor surface facing the indoor portion and an outdoor surface facing the outdoor portion, the outdoor surface of the wall defining a bulkhead bead projecting outward therefrom and extending around the opening, the bulkhead bead being formed by a first angled surface and a second angled surface meeting at a ridge; and a cover assembly for covering the opening, the cover assembly comprising:

a cover; and a gasket disposed between the cover and the outdoor surface of the wall, the gasket having a sealing portion defining a gasket bead projecting outward therefrom and extending around the sealing portion, wherein the gasket bead is in sealing engagement with the cover and the bulkhead bead is in sealing engagement with the sealing portion of the gasket, and wherein the ridge of the bulkhead bead and a ridge of the gasket bead are substantially aligned, and wherein the gasket bead is formed by a first angled surface and a second angled surface that together define a depression, and wherein the bulkhead bead extends into and substantially fills the depression such that the first and second angled surfaces of the bulkhead bead engage the first and second angled surfaces of the gasket bead, respectively.

17. The air conditioner unit of claim 16, wherein a drain is defined by the cover and the gasket between an outer flange of the gasket and the gasket bead projecting outward from the sealing portion, and wherein the gasket extends between a top end and a bottom end, and wherein the gasket has a wire guide extending from the sealing portion at the bottom end, and wherein the wire guide defines one or more wire passages and one or more drain passages in fluid communication with the drain and configured for draining liquid therefrom.

18. The air conditioner unit of claim 17, wherein the gasket extends between a first side and a second side, and wherein the wire guide has a top portion having a first angled surface that is sloped downward from a middle of the wire guide toward the first side along the vertical direction and a second angled surface that is sloped downward from the middle of the wire guide toward the second side along the vertical direction such that the first and second angled surfaces form a ridge at the middle of the wire guide at the top portion.

19. The air conditioner unit of claim 16, wherein the wall of the bulkhead defines one or more alignment openings, and wherein the sealing portion of the gasket defines one or more alignment posts projecting inward therefrom that are each insertable into an associated one of the one or more alignment openings.

20. The air conditioner unit of claim 16, wherein the depression defined by the gasket bead has a triangular cross section and the bulkhead bead has a triangular cross section shaped complementary to the triangular cross section of the depression.

* * * * *